US006837834B2

(12) United States Patent
Basting

(10) Patent No.: US 6,837,834 B2
(45) Date of Patent: Jan. 4, 2005

(54) EXERCISE DEVICE AND METHOD OF USING SAME

(76) Inventor: Jack Basting, 2312 D Crestview Dr., Hudson, WI (US) 54016

( * ) Notice: Subject to any disclaimer, the term of this patent is extended or adjusted under 35 U.S.C. 154(b) by 43 days.

(21) Appl. No.: 10/120,099

(22) Filed: Apr. 10, 2002

(65) Prior Publication Data

US 2003/0195092 A1 Oct. 16, 2003

(51) Int. Cl.[7] ..... A63B 21/00
(52) U.S. Cl. ..... 482/124; 482/74; 482/121
(58) Field of Search ..... 2/303, 306, 312, 2/316; 482/124, 121, 105, 74, 122, 139, 907, 748

(56) References Cited

U.S. PATENT DOCUMENTS

| | | | | |
|---|---|---|---|---|
| 1,663,641 A | | 3/1928 | Smallwood | |
| 2,467,943 A | | 4/1949 | Mikell, Jr. | |
| 3,334,898 A | | 8/1967 | McCrory et al. | |
| 4,690,402 A | | 9/1987 | Basting | |
| 4,944,043 A | * | 7/1990 | Bush | |
| 5,109,546 A | | 5/1992 | Dicker | 2/70 |
| 5,129,647 A | | 7/1992 | Castellanos | 482/124 |
| 5,158,510 A | | 10/1992 | Lemire | 482/51 |
| 5,203,754 A | | 4/1993 | Maclean | 482/124 |
| 5,367,708 A | | 11/1994 | Fujimoto | 2/22 |
| 5,490,826 A | | 2/1996 | Rose | 482/74 |
| 5,570,472 A | | 11/1996 | Dicker | 2/69 |
| 5,802,822 A | * | 9/1998 | Holzhauser | 54/46.1 |
| 5,951,443 A | | 9/1999 | Askins | 482/74 |
| 5,960,474 A | | 10/1999 | Dicker et al. | 2/69 |
| 6,179,760 B1 | | 1/2001 | Rumbaugh | 482/121 |
| 6,190,342 B1 | | 2/2001 | Taylor | 602/19 |
| 6,220,994 B1 | | 4/2001 | Rich | 482/123 |
| 6,299,569 B1 | | 10/2001 | Rich | 482/123 |
| 6,368,256 B1 | * | 4/2002 | Rumbaugh | 482/121 |
| 6,393,622 B1 | * | 5/2002 | Rice | 2/406 |
| 6,428,495 B1 | * | 8/2002 | Lynott | 602/23 |
| 6,551,221 B1 | * | 4/2003 | Marco | 482/74 |

* cited by examiner

*Primary Examiner*—Jerome W. Donnelly
(74) *Attorney, Agent, or Firm*—Kinney & Lange, P.A.

(57) ABSTRACT

An exercise device to selectively exercise leg muscles. The exercise device comprises a waist portion, a rigid member attachable to the waist portion and an elastic strap attachable to the rigid member and a foot of a user. The rigid member is positionable about the waist member to position the elastic strap either along a forward portion of a leg or along a rearward portion of the leg. The elastic strap provides resistance of which can be varied by varying the length of the elastic strap.

14 Claims, 5 Drawing Sheets

EXERCISE DEVICE AND METHOD OF USING SAME

BACKGROUND OF THE INVENTION

The present invention relates to exercise equipment. In particular, the present invention relates to an exercising device that is worn by a user to selectively exercise selected groups of leg muscles.

There are several devices known in the art that are worn by the user to provide additional resistance while exercising leg muscles. Such devices are disclosed in the following patents:

| Inventor | U.S. Patent No. |
|---|---|
| Dicker | 5,109,546 |
| Castellanos | 5,129,647 |
| Maclean | 5,203,754 |
| Rose | 5,490,826 |
| Rumbarugh | 6,179,760 |

Most of the devices are bulky, and include various and numerous adjustment means for fitting the devices to the specific user. Some of the devices are also garments in and of themselves, or can not easily be worn under clothing. Furthermore, it would be difficult to wear the aforementioned devices if the user was attempting to discreetly wear such devices in an ordinary public setting.

BRIEF SUMMARY OF THE INVENTION

The present invention includes an exercise device worn by a user to selectively exercise select leg muscle groups. The exercise device comprises a waist member securable about a waist or mid-section of the user by a belt, and adjustable resistance portions securable to the user's feet and positionably attachable to the waist member. The resistance portions include an attachable member securable to the waist member, elastic straps stretchable in a longitudinal direction and attachable to the attaching members, and loop portions securable to the feet and attached to elastic straps. The elastic straps can be lengthened or shortened to decrease or increase, respectively, the amount of resistance provided by each strap. The length of each strap is adjustable by winding or unwinding each strap about the attachable member.

DETAILED DESCRIPTION

Figure 1:
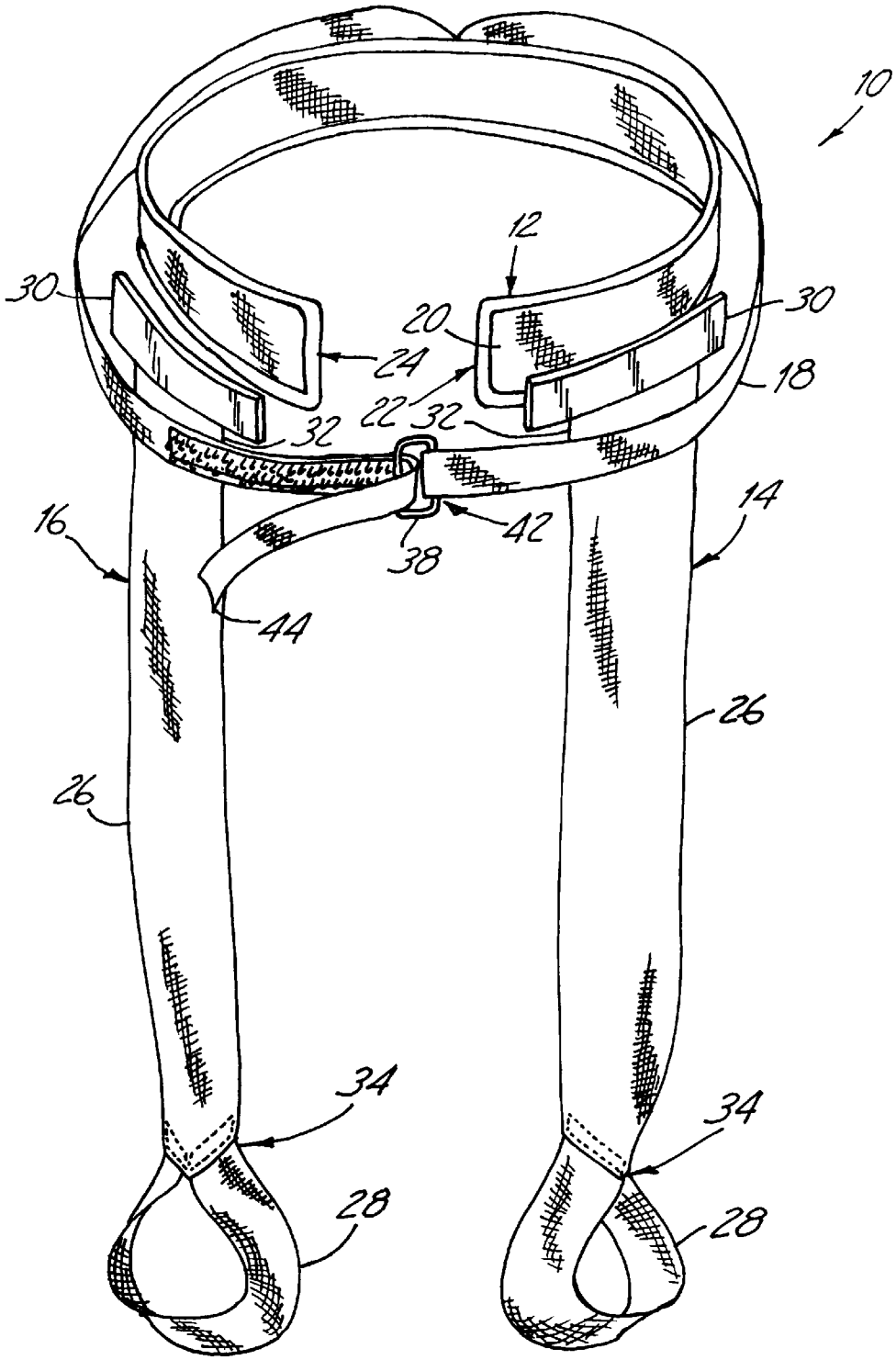
FIG. 1 is a perspective view illustrating an exercising device of the present invention.

The exercise device of the present invention is generally indicated at 10 in FIG. 1. The exercise device 10 may be worn by a user to selectively exercise certain leg muscle groups, namely the quadriceps and gluteus maximi. The exercise device 10 generally comprises a waist member 12, first and second attachable resistance portions 14 and 16, and a belt 18.

The waist member 12 is positionable about a waist or mid-section of the user. The waist or mid-section of the user may be defined as the portion of the human body located between the thorax and hips. However, it is well within the scope of the present invention that the waist or mid-section of the user further include a portion of the human body extending slightly below the hips. The waist member 12 is preferably constructed of a flexible material and may include a foam padding insert (not shown) sewn into the flexible material. An exterior surface 20 of the waist member 12 includes hook and loop fasteners, such as VELCRO®, disposed thereon. The length of the waist member 12 should be long enough to circumferentially circumscribe the waist or mid-section of the user such that opposing ends 22 and 24 of the waist member 12 are adjacent to respective frontal thigh regions of the user.

Attached to the waist member 12 are resistance portions 14 and 16. Each resistance portion 14 and 16 includes a strap of elastic material 26 sewn to a loop portion 28, and an attaching member 30 attachable to the elastic strap 26 and the waist member 12. Preferably, the attaching member 30 is constructed of rigid material, such as plastic. However, it is within the scope of the present invention to construct the attaching member 30 of any suitable material durable to support attaching the elastic straps 26 to the waist member 12. The attaching member 30 and a proximate end 32 of the elastic strap 26 each include a surface having mateable hook and loop fasteners disposed thereon for attachment to one another. Each elastic strap 26 has a width less than a length of each attaching member 30. As such, the proximate end 32 of each elastic strap 26 attaches to less then a full surface area of each attaching member 30. The remaining surface area of the attaching members 30 mateably attaches to the hook and loop fasteners of the waist member 12.

The loop portion 28 is preferably constructed of a durable, non-elastic material. The loop portion 28 is designed to be secured to a foot of the user, and in so doing, secures a distal end 34 of the resistance portion 14 and 16 to the respective foot of the user. Preferably, the loop portion 28 may be secured to the foot of the user while the user is wearing socks, thus allowing the user to don shoes with the loop 28 secured to the foot. However, it is within the scope of the present invention that the loop portion 28 may be securable over a shoe, or also a bare foot.

Each elastic strap 26 may be constructed of any suitable material that exhibits stretchability, elasticity or similar properties in a longitudinal direction. Preferably, each elastic strap 26 is constructed of spandex, such as LYCRA® sold by E.I. DuPont de Memours and Company Corporation of Wilmington, Del.

Figure 2:
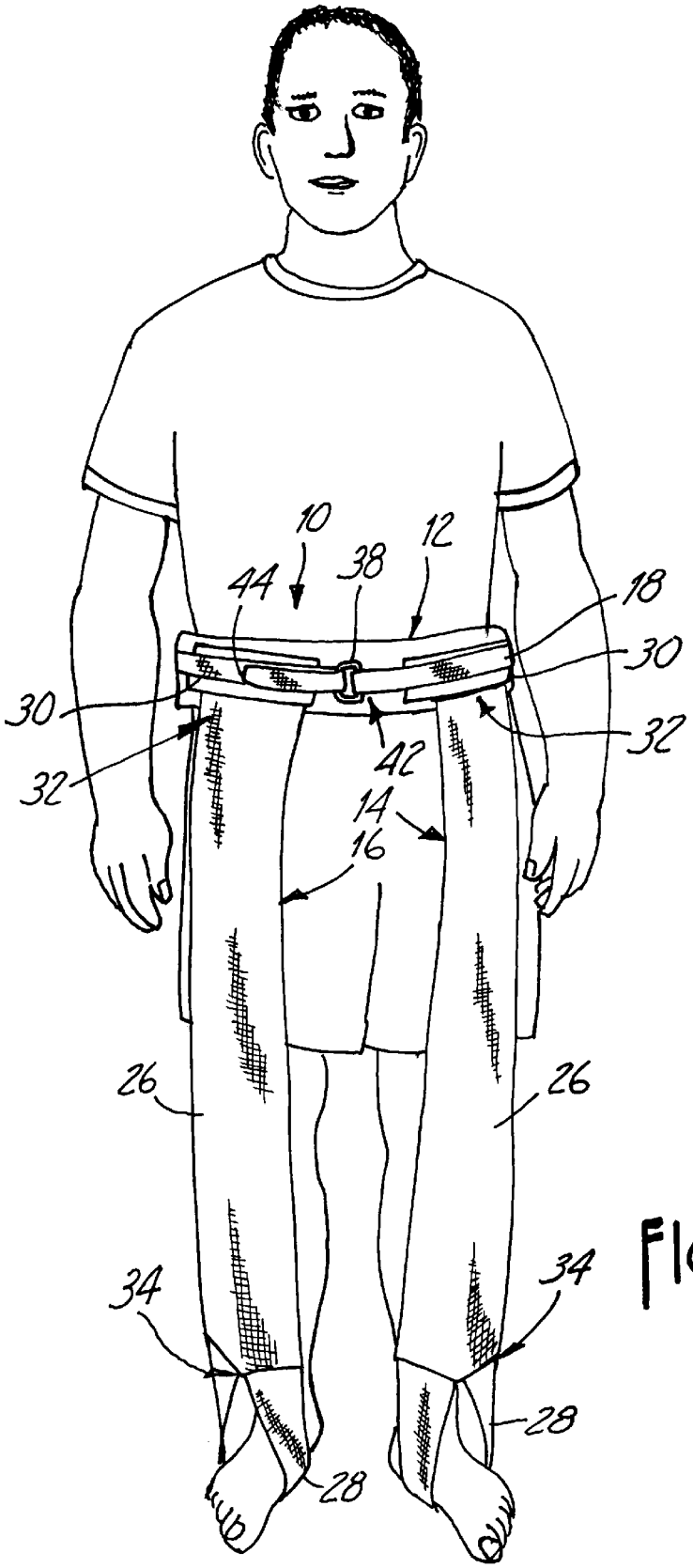
FIG. 2 is a perspective view of the exercise device of the present invention worn by a user to exercise rear leg muscle groups.

To use the exercise device 10 of the present invention, the user first chooses which muscle groups to exercise, and upon choosing, selectively positions each resistance portion 14 and 16 to correspond with the muscle group desired to be exercised. If the gluteus maximi are the chosen group, the user positions the resistance portion 14 or 16 such that the elastic strap 26 is adjacent to a front thigh portion of the leg, as illustrated in FIG. 2. If the quadriceps are the chosen group, the user positions the resistance portion 14 or 16 such that the elastic strap 26 is adjacent to a back portion of the leg, as illustrated in FIG. 3.

When positioning each resistance portion 14 and 16, each attaching member 30 is firmly pressed into place to ensure that the mateable hook and loop fasteners exposed upon the surface of the attaching member 30 come within full and intimate contact with the hook and loop fasteners disposed upon the waist member 12. Also, it should be noted that it is within the scope of the present invention to position the first resistance portion 14 to exercise the quadricep muscle group and to position the second resistance portion 16 to exercise the gluteus maximus of the other leg. Alternatively, it would also be within the scope of the present invention to add another set of resistance portions (i.e., a total of four resistance portions), with a first set positioned to provide resistance against the gluteus maximi, and the second set positioned to provide resistance against the quadriceps.

Figure 3:
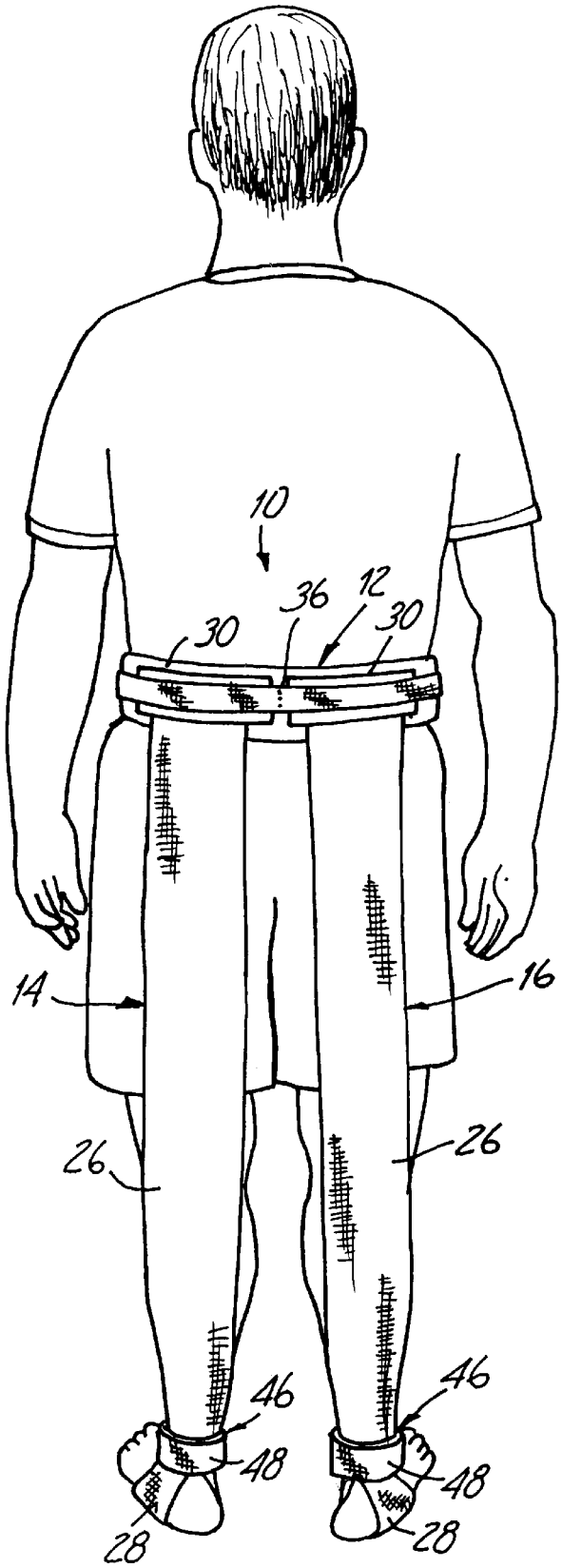
FIG. 3 is a perspective view of the exercise device of the present invention worn by the user to exercise front leg muscle groups.

To further secure the attaching members 30 to the waist member 12, and to secure the exercise device 10 to the waist or mid-section of the user, the belt 18 circumferentially circumscribes the waist member 12 and attaching members 30 about the waist or mid-section of the user, as illustrated in FIGS. 2 and 3. Preferably, the belt 18 may be attached to the waist at a center position 36, as illustrated in FIG. 3. However, it is within the scope of the present invention to attach the belt 18, if at all, along any portion of the waist member 12. The belt 18 may be made of any suitable material, and may include any combination of buckling units to secure the belt to the user. Preferably, the belt includes a loop member 38, and hook and loop fasteners disposed on an outward surface 40. The loop member 38 attaches to a first end of the belt 42, and a second end 44 is passed through the loop 38 wherein the second end 44 includes the hook and loop fasteners, and is attached along the outer surface 40 of the belt 18 where mating hook and loop fasteners are disposed. This type of belt 18 provides a "one size fits all" type of belt for users having a wide array of waist sizes.

Additionally, the exercise device 10 may further include removable cuff portions 46 that secure distal ends 34 of the resistance portions 14 and 16 to respective ankles of the user, as illustrated in FIG. 3. Each cuff 46 is be constructed of a flexible material, and preferably includes a hook and loop fastener disposed on a first surface 48, and a mating hook and loop fastener disposed upon a portion of an opposing second surface (not shown). Each cuff 46 is positioned about the distal ends 34 of the respective resistance portion 14 and 16 and ankle such that the first surface 48 faces outwardly, and the hook and loop portion of the second surface contacts and attaches to the first surface 48 at a selected position to snugly fit each cuff 46 to the respective ankle.

Figure 4:
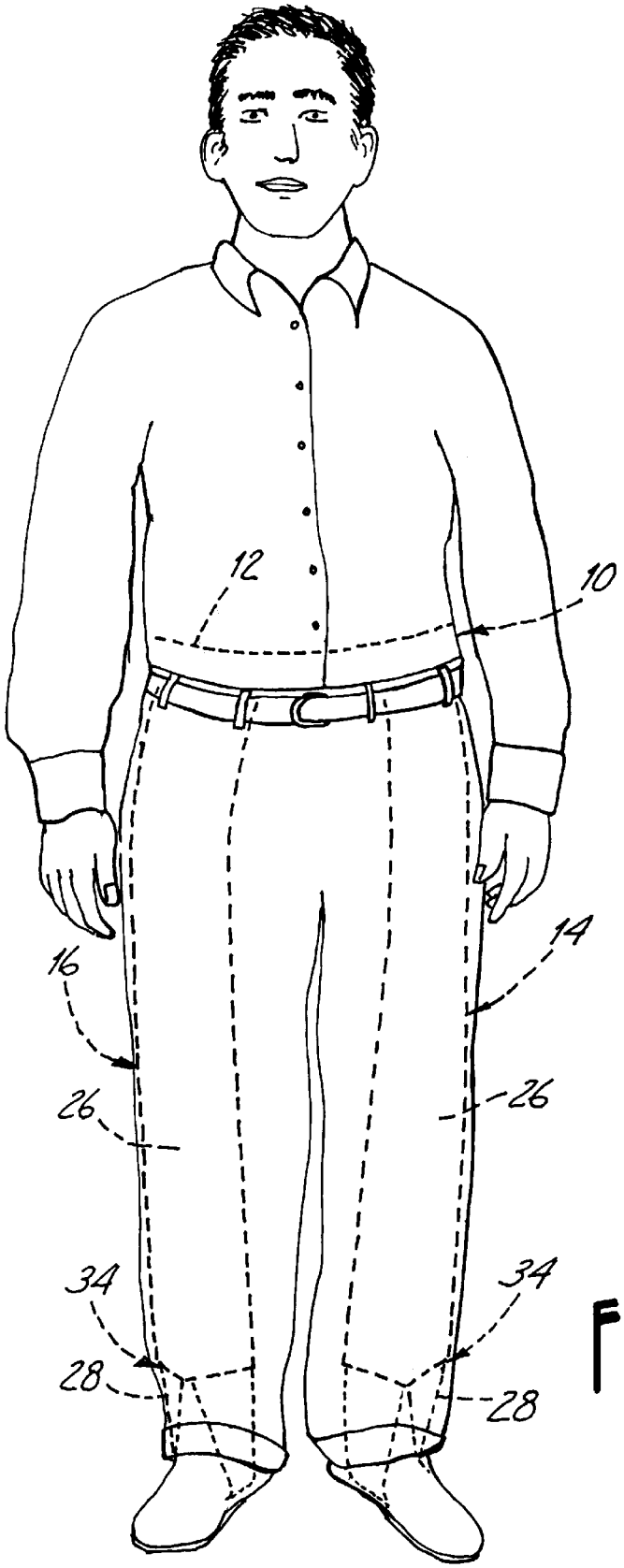
FIG. 4 is a perspective view of the exercise device of the present invention worn underneath clothing of the user to exercise rear leg muscle groups.
Figure 5:
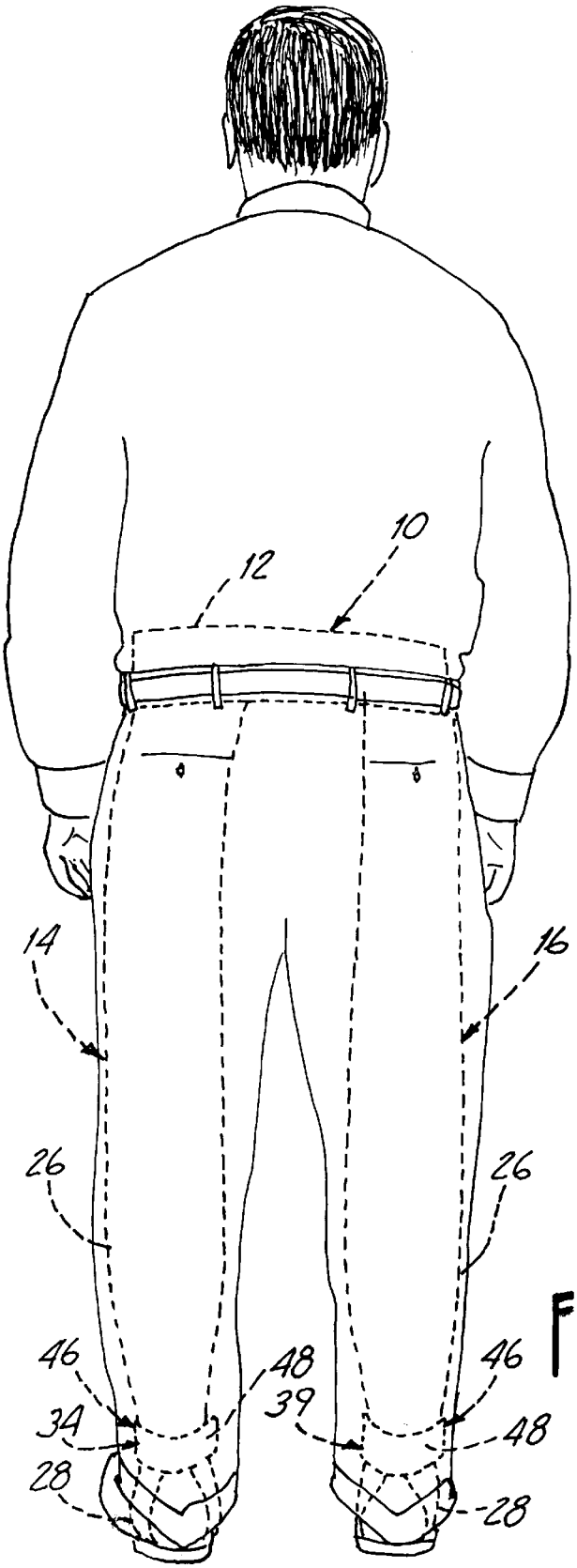
FIG. 5 is a perspective view of the exercise device of the present invention worn underneath clothing of the user to exercise front leg muscle groups.

The exercise device 10 of the present invention is worn outside the user's clothing as illustrated in FIGS. 2 and 3. Alternatively, the exercise device 10 is also worn underneath the user's clothing, as illustrated in FIGS. 4 and 5. The user may choose to wear the exercise device 10 outside of the clothing during periods of exercise. Alternatively, the user wears the exercise device while the user goes about regular daily activities, which include, but are not limited to, cleaning up around the house, shopping, going to the movies, during work at an office, mowing the lawn, and the like. By wearing the exercise device 10 underneath the clothes of the user, the user discreetly enjoys the benefits of added resistance provided by the device while going about regular daily activities wherein the legs are used. Thus, the exercise device provides extra resistance to the selected leg muscles while the user goes about his or her regular business. After several hours of use, the user has received the benefit of the added resistance to exercise the selected leg muscles without having to set aside a separate block of time to do so.

The amount of resistance provided by each strap 26 may be adjusted by increasing or decreasing the length of the strap 26. To increase the amount of resistance, the length of the strap 26 is decreased. This is accomplished by detaching the attaching member 30 from the waist member 12, if already attached, and winding the strap 26 about the attaching member 30. At the selected length wherein the strap 26 provides a desired amount of resistance, the attaching member 30 is attached to the waist member 12 at a position depending upon the muscle group desired to be exercised. Likewise, to decrease the amount of resistance, the length of the strap 26 may be increased. This is accomplished by detaching the attaching member 30 from the waist member 12, if already attached, and unwinding the strap 26 from the attaching member 30. At the selected length wherein the strap 26 provides an acceptable amount of resistance, the attaching member 30 is attached to the waist member 12 at a position depending upon the desired group of muscles to be exercised, as previously described.

Although the present invention has been described with reference to preferred embodiments, workers skilled in the art will recognize that changes may be made in form and detail without departing from the spirit and scope of the invention.

What is claimed is:

1. An exercise device for providing resistance to selectively exercise leg muscles of a user, the exercise device comprising:

a waist member securable to a waist portion or mid-section of the user said waist member further including one of a mateable hook or loop fastener attached to an outer surface of the waist member;

a positionable attaching member attachable to the waist member said attaching member further including one of a matable hook or loop fastener attached to a surface of the attaching member, the hook area loop fasteners suitable for selectively securing the attachable member to the waist member; and an elastic strap attachable to the attaching member, the elastic strap extending downwardly along a leg of the user;

a loop portion attached to the elastic strap for securing the elastic strap to a foot of the user;

a belt to secure the waist member to the waist portion or mid section of a user and to further assist insecuring the positional attaching member to the waist member;

wherein the attaching member positionably attaches along the waist member to selectively position the elastic strap in relation to the leg to selectively exercise the leg muscles.

2. The exercise device of claim 1 wherein the amount of resistance provided by the elastic strap is selectively varied by increasing or decreasing the length of the elastic strap, wherein the length of the elastic strap is selectively varied by winding the elastic strap about the attaching member.

3. The exercise device of claim 1 and further comprising a fastening mechanism disposed upon the elastic strap to removably attach the elastic strap to the attachable member.

4. The exercise device of claim 1 and further comprising a removable band to secure the elastic strap or the loop portion to the leg or ankle of the user.

5. The exercise device of claim 1 and further comprising a plurality of attaching members and a plurality of elastic straps.

6. A method of exercising leg muscles comprising:

securing an exercise device about a waist portion or mid-section of a user, the exercise device comprising:

a waist member securable to a waist portion or mid-section of the user, said waist member further including one of a mateable hook or loop fastener attached to an outer surface of the waist member;

a rigid positionable attaching member attachable to the waist member, said attaching member further including one of a mateable hook or loop fastener attached to a surface of the attaching member, the hook and loop fasteners suitable for selectively securing the attachable member to the waist member;

an elastic strap attachable to the attaching member, the elastic strap, extending downwardly along the leg of the user;

a loop portion attached to the elastic strap for securing the elastic strap to a foot of the user;

a belt to secure the waist member to the waist portion or mid section of a user and to further assist in securing the positional attaching member to the waist member;

wherein the attaching member positionably attaches along the waist member to selectively position the elastic strap in relation to the leg to selectively exercise the leg muscles' securing the elastic strap to the foot of the user;

adjusting the length of the elastic strap; and moving the leg of the user against the resistance provided by the elastic strap.

7. The method of claim 6 wherein an adjusting the length of the elastic strap comprises winding or unwinding the elastic strap about the rigid member to increase or decrease the length of the elastic strap.

8. The method of claim 6 and further comprising securing the elastic strap about an ankle or lower calf region of the user.

9. The method of claim 6 and further comprising selectively positioning the rigid member to position the elastic strap either proximate a generally frontward portion of the leg or proximate a generally rearward portion of the leg, the selected positioning of the elastic strap determining which leg muscles act against the resistance provided by the elastic strap.

10. an exercise device for selectively providing resistance to leg muscles, the device comprising:

a waist member securable to a waist portion or mid-section of the user; said waist member further comprising one of a mateable hook or loop fasteners attached to an outer surface of the waist member;

a positionable attaching member attachable to the waist member, said attaching member further including one of a mateable hook or loop fastener attached to a surface of the attaching member, the hook and loop fasteners suitable for selectively securing the attachable member to the waist member;

an elastic strap attachable to the attaching member the elastic strap, extending downwardly along the leg of the user;

a loop portion attached to the elastic strap for securing the elastic strap to a foot of the user;

a belt to secure the waist member to the waist portion or mid section of a user and to further assist in securing the positional attaching member to the waist member; and wherein the attaching member positional attaches along the waist member to selectively position the elastic strap in relation to the leg to selectively exercise the leg muscle.

11. The exercise device of claim 10, wherein said positionable attaching member is a rigid member, the elastic strap being attachable to the rigid member, the rigid member being attachable to the waist member to secure the elastic strap to the waist member.

12. The exercise device of claim 11 and further comprising a fastening mechanism disposed on an outer surface of the waist member, a surface of the rigid member and a surface of the proximal end of the elastic strap.

13. The exercise device of claim 12 wherein a lengthwise dimension of the rigid member is greater than a width dimension of the elastic strap to provide greater surface area for the rigid member to attach to the waist member.

14. The exercise device of claim 11 wherein the resistance provided by the elastic strap is selectively varied by varying the length of the elastic strap, the length of the elastic strap varied by winding the elastic strap about the rigid member.

* * * * *

UNITED STATES PATENT AND TRADEMARK OFFICE

CERTIFICATE OF CORRECTION

PATENT NO. : 6,837,834 B2
DATED : January 4, 2005
INVENTOR(S) : Jack Basting

It is certified that error appears in the above-identified patent and that said Letters Patent is hereby corrected as shown below:

Column 4,
Line 36, delete "area", insert -- and. --
Line 45, delete "insecuring", insert -- in securing --

Signed and Sealed this

Twenty-eighth Day of June, 2005

JON W. DUDAS
*Director of the United States Patent and Trademark Office*